US009352757B2

(12) United States Patent
Nishimura et al.

(10) Patent No.: US 9,352,757 B2
(45) Date of Patent: May 31, 2016

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 0 days.

(21) Appl. No.: 14/507,451

(22) Filed: Oct. 6, 2014

(65) Prior Publication Data

US 2015/0020708 A1 Jan. 22, 2015

Related U.S. Application Data

(63) Continuation of application No. 14/390,863, filed as application No. PCT/JP2013/001596 on Mar. 12, 2013.

(30) Foreign Application Priority Data

Apr. 6, 2012 (JP) ..... 2012-087064

(51) Int. Cl.
*B61F 3/02* (2006.01)
*B61F 5/30* (2006.01)

(52) U.S. Cl.
CPC .. *B61F 3/02* (2013.01); *B61F 5/302* (2013.01)

(58) Field of Classification Search
CPC ..... B61F 5/30; B61F 5/302; B61F 5/50; B61F 5/52
USPC ..... 105/197.05
See application file for complete search history.

(56) References Cited

U.S. PATENT DOCUMENTS 2,098,459 A * 11/1937 McWhirter ..... B61F 3/04 105/167
3,948,188 A * 4/1976 Zehnder ..... B60G 11/04 105/167

(Continued)

FOREIGN PATENT DOCUMENTS

DE 692 02 552 T2 11/1995
EP 0 547 010 B1 6/1993

(Continued)

OTHER PUBLICATIONS

Mar. 27, 2015 Extended Search Report issued in European Patent Application No. 14192341.7.

(Continued)

*Primary Examiner* — Jason C Smith
(74) *Attorney, Agent, or Firm* — Oliff PLC

(57) ABSTRACT

A railcar bogie includes: a cross beam configured to support a carbody of a railcar; a pair of front and rear axles between which the cross beam is located and which are respectively arranged in front of and behind the cross beam in a railcar longitudinal direction so as to extend in a railcar width direction; bearings respectively provided at both railcar width direction sides of the axles and configured to rotatably support the axles; axle box main bodies configured to respectively accommodate the bearings; plate springs extending in the railcar longitudinal direction to respectively support both railcar width direction end portions of the cross beam, both longitudinal direction end portions of the plate springs being respectively arranged above the axle box main bodies to be respectively supported by the axle box main bodies.

4 Claims, 8 Drawing Sheets

(56) References Cited

U.S. PATENT DOCUMENTS

| | | | | | |
|---|---|---|---|---|---|
| 4,175,772 | A * | 11/1979 | Lampert | B60G 17/023 | 267/262 |
| 4,332,201 | A * | 6/1982 | Pollard | B61F 3/04 | 105/167 |
| 4,363,277 | A * | 12/1982 | Martin | B61F 5/22 | 105/164 |
| 4,648,326 | A * | 3/1987 | Jackson | B61F 3/04 | 105/138 |
| 4,742,779 | A * | 5/1988 | Bevand | B61F 3/04 | 105/167 |
| 5,020,824 | A * | 6/1991 | Mounier-Poulat | B60G 5/053 | 267/266 |
| 5,039,071 | A * | 8/1991 | Irle | B61F 5/148 | 105/197.05 |
| 5,632,208 | A * | 5/1997 | Weber | B61F 3/10 | 105/182.1 |
| 6,119,602 | A * | 9/2000 | Yoshino | B61F 5/305 | 105/167 |
| 6,250,232 | B1 * | 6/2001 | Hachmann | B61F 5/325 | 105/157.1 |
| 6,338,300 | B1 * | 1/2002 | Landrot | B61F 5/305 | 105/182.1 |
| 7,934,458 | B2 * | 5/2011 | Gedenk | B61F 5/307 | 105/197.05 |
| 2005/0116436 | A1 * | 6/2005 | Landrot | B61F 5/305 | 280/124.109 |
| 2008/0229968 | A1 * | 9/2008 | Gedenk | B61F 5/305 | 105/198.7 |
| 2010/0107923 | A1 * | 5/2010 | Rodet | B61F 5/325 | 105/197.05 |
| 2011/0247520 | A1 * | 10/2011 | Liu | B61F 3/02 | 105/197.05 |
| 2014/0123870 | A1 * | 5/2014 | Nishimura | B61F 5/302 | 105/197.05 |
| 2015/0000553 | A1 * | 1/2015 | Kimura | B61F 5/30 | 105/197.05 |
| 2015/0020708 | A1 * | 1/2015 | Nishimura | B61F 5/302 | 105/197.05 |
| 2015/0083019 | A1 * | 3/2015 | Nishimura | B61F 5/32 | 105/197.05 |
| 2015/0107487 | A1 * | 4/2015 | Zanutti | B61F 5/325 | 105/172 |
| 2015/0158506 | A1 * | 6/2015 | Nishimura | B61F 5/52 | 105/197.05 |
| 2015/0251670 | A1 * | 9/2015 | Kamura | B61F 5/305 | 105/197.05 |

FOREIGN PATENT DOCUMENTS

| | | | |
|---|---|---|---|
| EP | 1 002 674 | A2 | 5/2000 |
| EP | 1 538 056 | A1 | 6/2005 |
| JP | S54-013106 | U | 6/1977 |
| JP | A-55-47950 | | 4/1980 |
| JP | U-55-92943 | | 6/1980 |
| JP | U-59-24605 | | 2/1984 |
| JP | A-63-312528 | | 12/1988 |
| JP | A-02-234818 | | 9/1990 |
| JP | U-3-13235 | | 2/1991 |
| JP | U-04-119266 | | 10/1992 |
| JP | B-2799078 | | 7/1998 |
| JP | A-2002-331931 | | 11/2002 |
| JP | A-2008-086299 | | 4/2008 |
| JP | A-2010-100177 | | 5/2010 |

OTHER PUBLICATIONS

Jun. 18, 2013 International Search Report issued in International Application No. PCT/JP2013/001596.

Nov. 6, 2015 Office Action issued in U.S. Appl. No. 14/390,863.

* cited by examiner

RAILCAR BOGIE

This is a Continuation of application Ser. No. 14/390,863 filed Oct. 6, 2014, which in turn is a National Phase of PCT/JP2013/001596, filed Mar. 12, 2013 which claims the benefit of Japanese Application No. 2012-087064 filed Apr. 6, 2012. The disclosure of the prior applications is hereby incorporated by reference herein in its entirety.

TECHNICAL FIELD

The present invention relates to a railcar bogie from which side sills are omitted, and particularly to a railcar bogie in which positional adjustments of plate springs and adjustments of wheel loads are easily performed.

BACKGROUND ART

A bogie for supporting a carbody of a railcar and allowing the railcar to run along a rail is provided under a floor of the carbody. In the bogie, axle boxes each configured to accommodate a bearing for supporting a wheelset are supported by an axle box suspension so as to be displaceable relative to a bogie frame in an upper-lower direction. For example, in PTL 1, the bogie frame includes a cross beam extending in a lateral direction and a pair of left and right side sills respectively extending from both end portions of the cross beam in a front-rear direction, and the axle box suspension includes axle springs constituted by coil springs each provided between the axle box and the side sill located above the axle box. PTL 2 proposes the bogie in which the side sills are omitted from the bogie frame.

CITATION LIST

Patent Literature

PTL 1: Japanese Patent No. 2799078

PTL 2: Japanese Laid-Open Patent Application Publication No. 55-47950

SUMMARY OF INVENTION

Technical Problem

In the bogie of PTL 1, the bogie frame constituted by the cross beam and the side sills is manufactured by, for example, welding heavy steel members to one another. Therefore, problems are that the weight of the bogie frame becomes heavy, and the cost for the steel members and the assembly cost become high. In contrast, the bogie of PTL 2 is configured such that: plate springs are used as primary suspensions; and the plate springs also serve as the side sills, and the side sills of the bogie frame are omitted. Specifically, the bogie of PTL 2 is configured such that: square tubular attaching portions are respectively provided at both lateral-direction end portions of the cross beam; front-rear-direction middle portions of the plate springs are respectively inserted through hollow portions of the attaching portions; each of spacers is arranged in a gap between the attaching portion and the plate spring to position and hold the plate spring; and both front-rear direction end portions of each of the plate springs are respectively inserted in spring receivers provided at axle box portions.

In the bogie of PTL 2, only the front-rear-direction middle portion of the plate spring is held. Therefore, in a case where this holding force is inadequate, there is a possibility that the plate spring is displaced in a longitudinal direction of the plate spring. On this account, the plate spring may not adequately achieve its function. Here, an object of the present invention is to prevent the plate spring from being displaced in the longitudinal direction of the plate spring beyond the scope of the assumption.

In the bogie of PTL 2, in order to adjust the balance of the wheel loads of the wheels, it is necessary to insert a liner between each plate spring and each axle box portion which transfer the load from the carbody to each wheel. However, to insert the liner, the plate spring has to be detached once, and this deteriorates workability. Here, another object of the present invention is to facilitate the adjustments of the wheel loads of the bogie using the plate springs.

Solution to Problem

A railcar bogie according to one aspect of the present invention includes: a cross beam configured to support a carbody of a railcar; a pair of front and rear axles between which the cross beam is located and which are respectively arranged in front of and behind the cross beam in a railcar longitudinal direction so as to extend in a railcar width direction; bearings respectively provided at both railcar width direction sides of the axles and configured to rotatably support the axles; axle box main bodies configured to respectively accommodate the bearings; plate springs extending in the railcar longitudinal direction to respectively support both railcar width direction end portions of the cross beam, both longitudinal direction end portions of the plate springs being respectively arranged above the axle box main bodies to be respectively supported by the axle box main bodies; and a first side wall arranged at a plate spring longitudinal direction outer side of each of the longitudinal direction end portions of the plate springs and configured to restrict parallel displacement of the plate spring relative to an upper surface of the axle box main body in the longitudinal direction, the parallel displacement being longer than predetermined parallel displacement.

According to the above configuration, the first side wall is arranged at the longitudinal direction outer side of the longitudinal direction end portion of the plate spring so as to restrict the parallel displacement of the plate spring relative to the upper surface of the axle box main body in the longitudinal direction, the parallel displacement being longer than predetermined parallel displacement. Therefore, the plate spring can be prevented from being displaced in the longitudinal direction of the plate spring beyond the scope of the assumption.

A railcar bogie according to another aspect of the present invention includes: a cross beam configured to support a carbody of a railcar; a pair of front and rear axles between which the cross beam is located and which are respectively arranged in front of and behind the cross beam in a railcar longitudinal direction so as to extend in a railcar width direction; bearings respectively provided at both railcar width direction sides of the axles and configured to rotatably support the axles; axle box main bodies configured to respectively accommodate the bearings; plate springs extending in the railcar longitudinal direction to respectively support both railcar width direction end portions of the cross beam, vicinities of both longitudinal direction ends of the plate springs being respectively supported by the axle box main bodies, each of the plate springs being provided with first overhang portions each projecting toward a longitudinal direction outer side from an end portion of a supporting surface of the axle box main body; and second overhang portions respectively formed integrally with the axle box main bodies or respectively supported by the axle box main bodies, and respectively separated from and opposed to lower surfaces of the first overhang portions, wherein a bolt hole is formed at a position of one of the first overhang portion and the second overhang portion, the position being opposed to the other of the first overhang portion and the second overhang portion.

According to the above configuration, a bolt is inserted and screwed into the bolt hole formed at one of the first overhang portion and the second overhang portion. With this, a tip end of the bolt contacts a surface of the other of the first overhang portion and the second overhang portion. Thus, the first overhang portion can be separated from the second overhang portion. By inserting a liner into a gap formed as above, the adjustment of the wheel loads of the bogie can be easily performed.

Advantageous Effects of Invention

As is clear from the above explanations, according to the railcar bogie of the present invention, the first side walls can prevent the plate springs from being displaced in the longitudinal direction of the plate spring beyond the scope of the assumption. In addition, the adjustment of the wheel loads of the bogie can be easily performed.

DESCRIPTION OF EMBODIMENTS

Hereinafter, embodiments will be explained in reference to the drawings.

Embodiment 1

Figure 1:
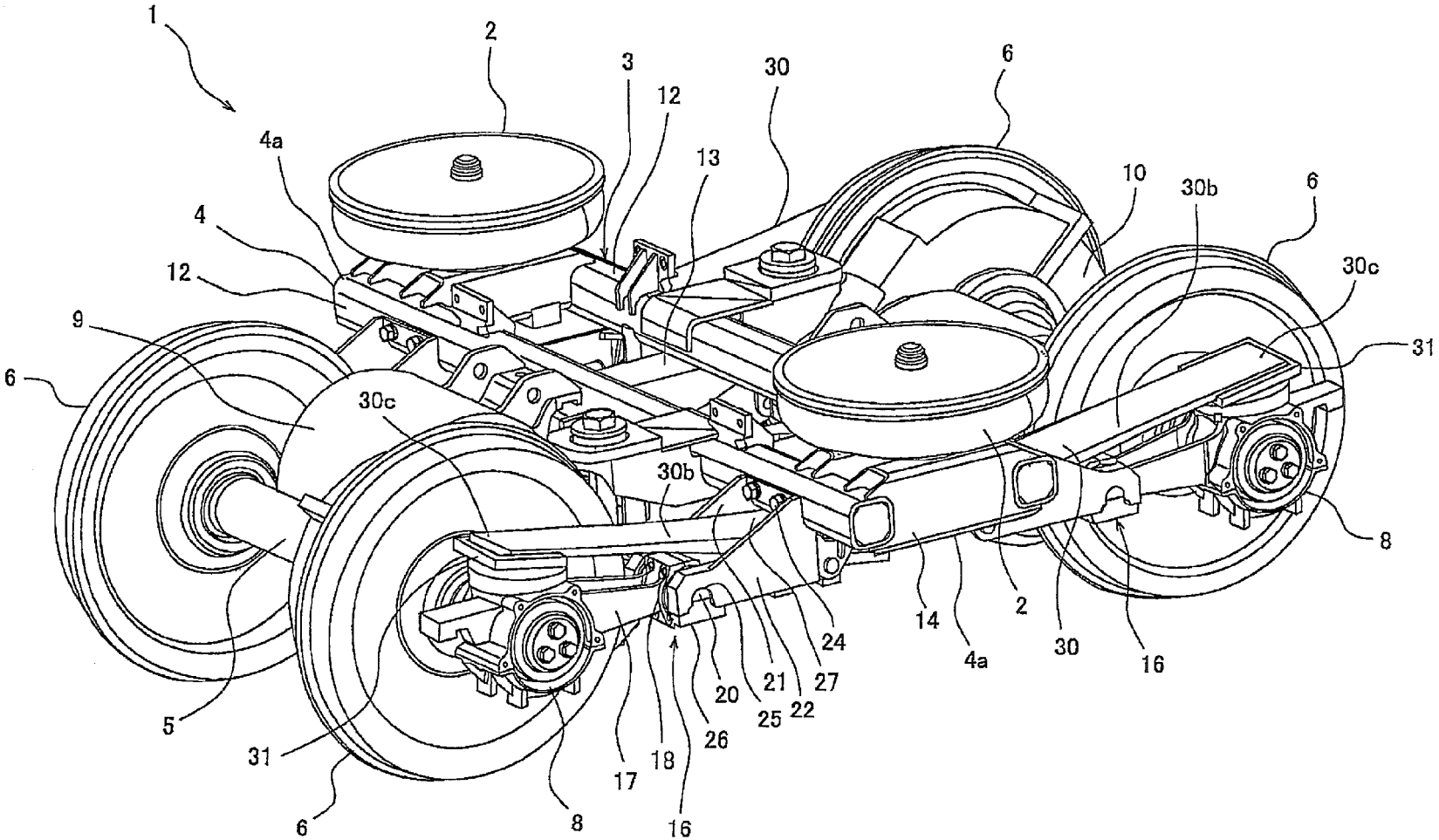
FIG. 1 is a perspective view showing a railcar bogie according to Embodiment 1.
Figure 2:
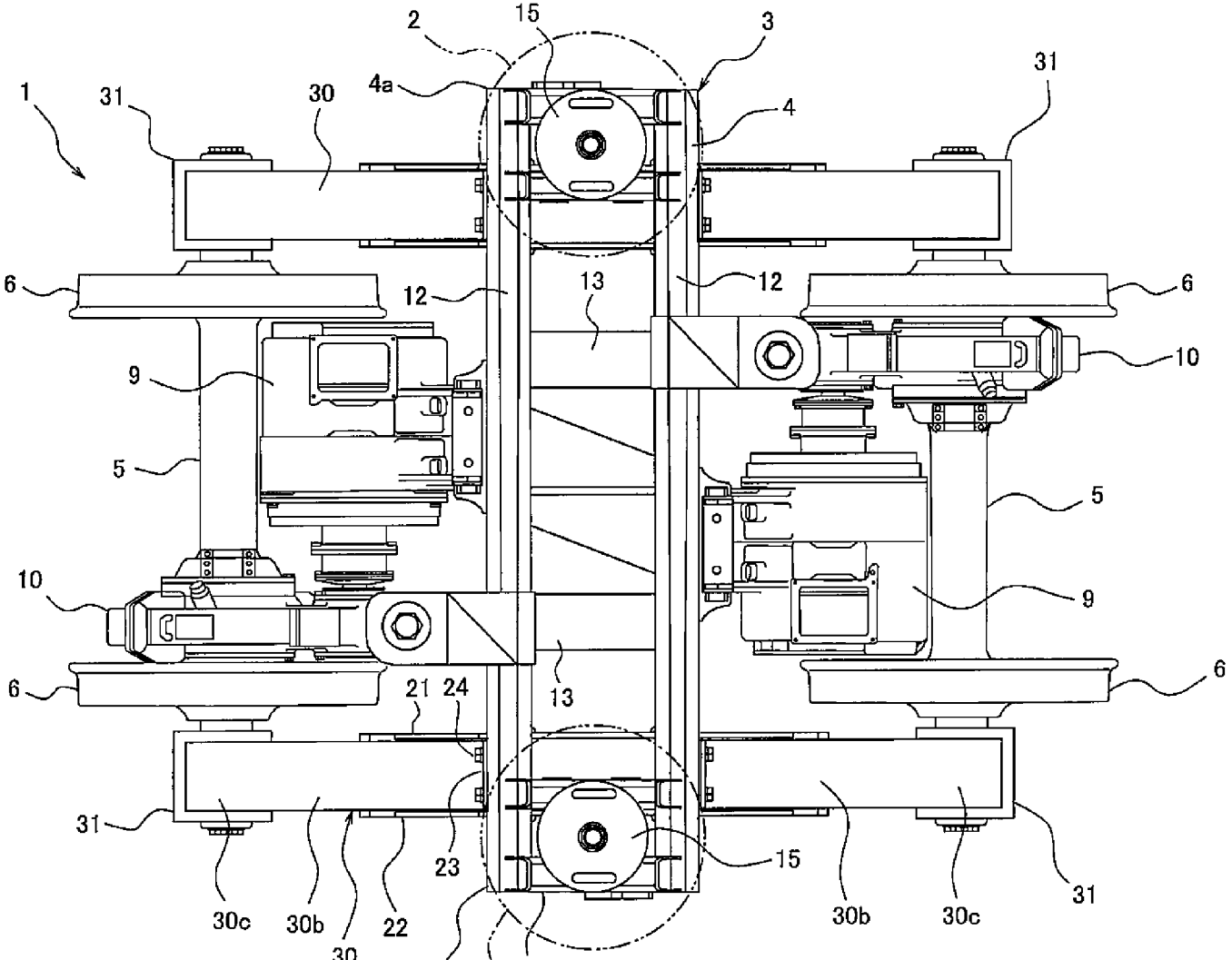
FIG. 2 is a plan view of the bogie shown in FIG. 1.
Figure 3:
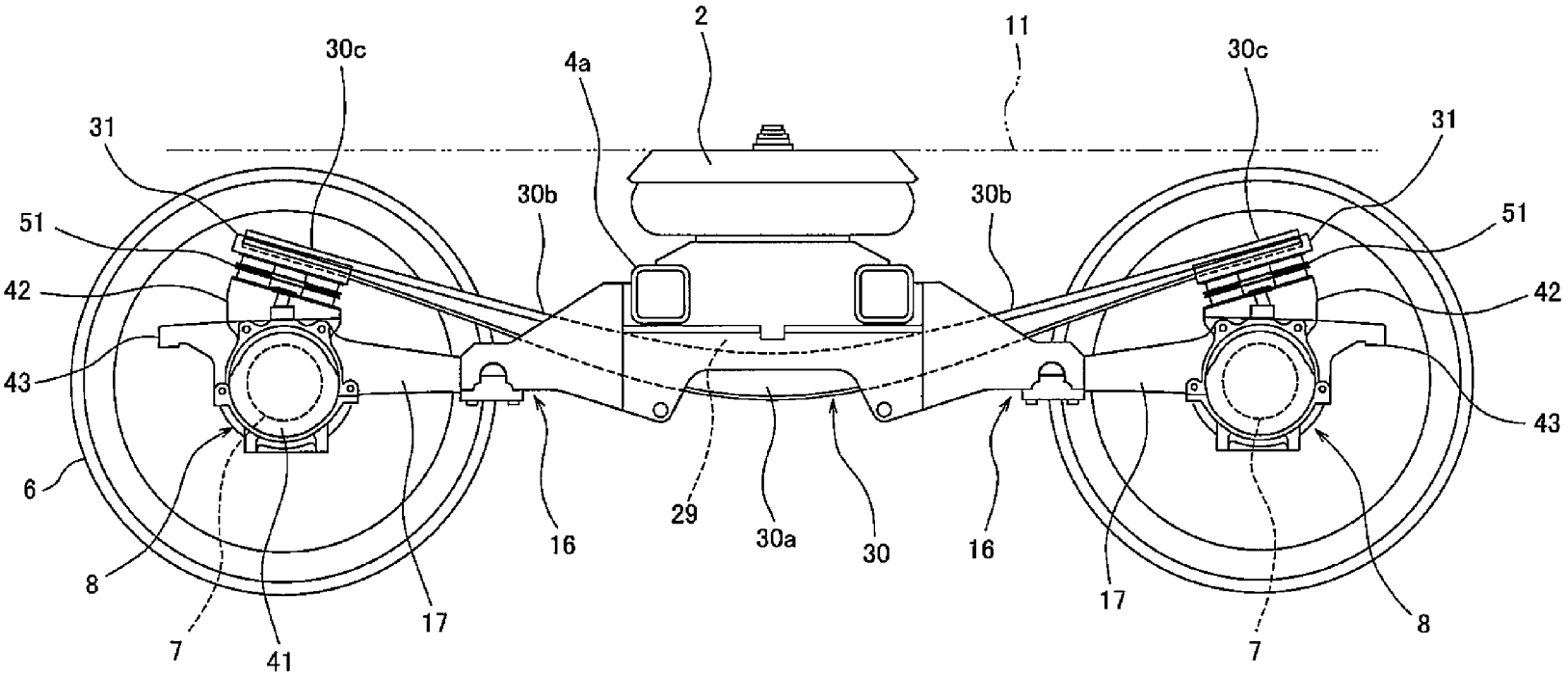
FIG. 3 is a side view of the bogie shown in FIG. 1.

FIG. 1 is a perspective view showing a railcar bogie 1 according to Embodiment 1. FIG. 2 is a plan view of the bogie 1 shown in FIG. 1. FIG. 3 is a side view of the bogie 1 shown in FIG. 1. As shown in FIGS. 1 to 3, the railcar the bogie 1 includes a bogie frame 3 configured to support a carbody 11 via air springs 2 serving as secondary suspensions. The bogie frame 3 includes a cross beam 4 extending in a railcar width direction (hereinafter may be simply referred to as a "width direction") that is a left-right direction and supporting the carbody 11. However, unlike the configurations of conventional railcar bogies, the bogie frame 3 does not include side sills respectively extending from both railcar width direction end portions of the cross beam 4 in a railcar longitudinal direction (hereinafter may be referred to as a "front-rear direction"). A pair of front and rear axles 5 are respectively arranged in front of and behind the cross beam 4 so as to extend in the railcar width direction. Wheels 6 are respectively fixed to both railcar width direction sides of each axle 5. Bearings 7 configured to rotatably support the axle 5 are respectively provided at both railcar width direction end portions of the axle 5 so as to be respectively located outside the wheels 6 in the railcar width direction. The bearings 7 are accommodated in axle box main bodies 41 of axle box portions 8. Electric motors 9 are attached to the cross beam 4, and gear boxes 10 each of which accommodates a reduction gear configured to transmit power to the axle 5 are respectively connected to output shafts of the electric motors 9.

The cross beam 4 includes: a pair of square pipes 12 extending in the railcar width direction; and connecting plates 13 and 14 connecting the square pipes 12. The connecting plates 13 and 14 are fixed to the square pipes 12 by bolts, or the like. A pair of tubular connecting plates 14 are provided at each of both railcar width direction end portions 4*a* of the cross beam 4 so as to be spaced apart from each other. Each of air spring bases 15 is disposed on upper surfaces of the pair of connecting plates 14. Each of the railcar width direction end portions 4*a* of the cross beam 4 is coupled to the axle box portions 8 by coupling mechanisms 16. Each of the coupling mechanisms 16 includes an axle beam 17 extending in the front-rear direction integrally from the axle box portion 8. A tubular portion 18 that has a cylindrical inner peripheral surface and opens at both railcar width direction sides thereof is provided at an end portion of each axle beam 17.

A core rod 20 is inserted through an internal space of each tubular portion 18 via a rubber bushing (not shown). Two pairs of receiving seats 21 and 22 constituting the coupling mechanisms 16 are provided at each railcar width direction end portion 4*a* of the cross beam 4 so as to project in the front-rear direction. A fitting groove 25 that opens downward is formed at each of the receiving seats 21 and 22. Both lateral direction end portions of the core rod 20 are respectively fitted into the fitting grooves 25 of the receiving seats 21 and 22 from below. In this state, a lid member 26 is fixed to the receiving seats 21 and 22 by bolts (not shown) from below so as to close lower openings of the fitting grooves 25 of the receiving seats 21 and 22. Thus, the core rod 20 is supported by the lid member 26 from below.

Each of plate springs 30 extending in the front-rear direction is provided between the cross beam 4 and the axle box portion 8. Longitudinal direction middle portions 30*a* of the plate springs 30 respectively support the railcar width direction end portions 4*a* of the cross beam 4, and longitudinal direction end portions 30*c* of the plate springs 30 are respectively supported by the axle box portions 8. To be specific, each of the plate springs 30 serves as both a primary suspension and a conventional side sill. The longitudinal direction middle portions 30*a* of the plate springs 30 are arranged under the cross beam 4. Contact members 29 each having a circular-arc lower surface are respectively provided under both railcar width direction end portions 4*a* of the cross beam 4. The contact members 29 are respectively disposed on the longitudinal direction middle portions 30*a* of the plate springs 30 from above to respectively, freely contact the longitudinal direction middle portions 30*a*. To be specific, each of the contact members 29 contacts an upper surface of the plate spring 30 by a downward load from the cross beam 4 due to gravity so as not to fix the plate spring 30 in the upper-lower direction.

Each of the axle box portions 8 includes: the axle box main body 41 in which the bearing 7 is accommodated; a spring seat 42 attached to an upper portion of the axle box main body 41; and a projecting portion 43 projecting from the axle box main body 41 to an outer side in the front-rear direction. Both front-rear direction end portions 30*c* of the plate spring 30 are respectively supported by the spring seats 42 from below. Specifically, each of the front-rear direction end portions 30*c* of the plate springs 30 is disposed on the spring seat 42 from above via a below-described gap portion 51 and a below-described receiving member 31 to freely contact an upper surface of the receiving member 31.

In the plate spring 30, a part of each of extending portions 30*b* each extending between the longitudinal direction middle portion 30*a* and the longitudinal direction end portion 30*c* passes through a space 27 sandwiched between a pair of receiving seats 21 and 22 to pass through a lower side of a coupling plate 23 and then reach a position under the cross beam 4. The extending portions 30*b* and longitudinal direction end portions 30*c* of the plate spring 30 are inclined downward toward the longitudinal direction middle portion 30*a* in a side view. The longitudinal direction middle portion 30*a* of the plate spring is located at a position lower than the longitudinal direction end portion 30*c* of the plate spring 30. To be specific, each of the plate springs 30 is formed in a bow shape that is convex downward as a whole in a side view.

Figure 4:
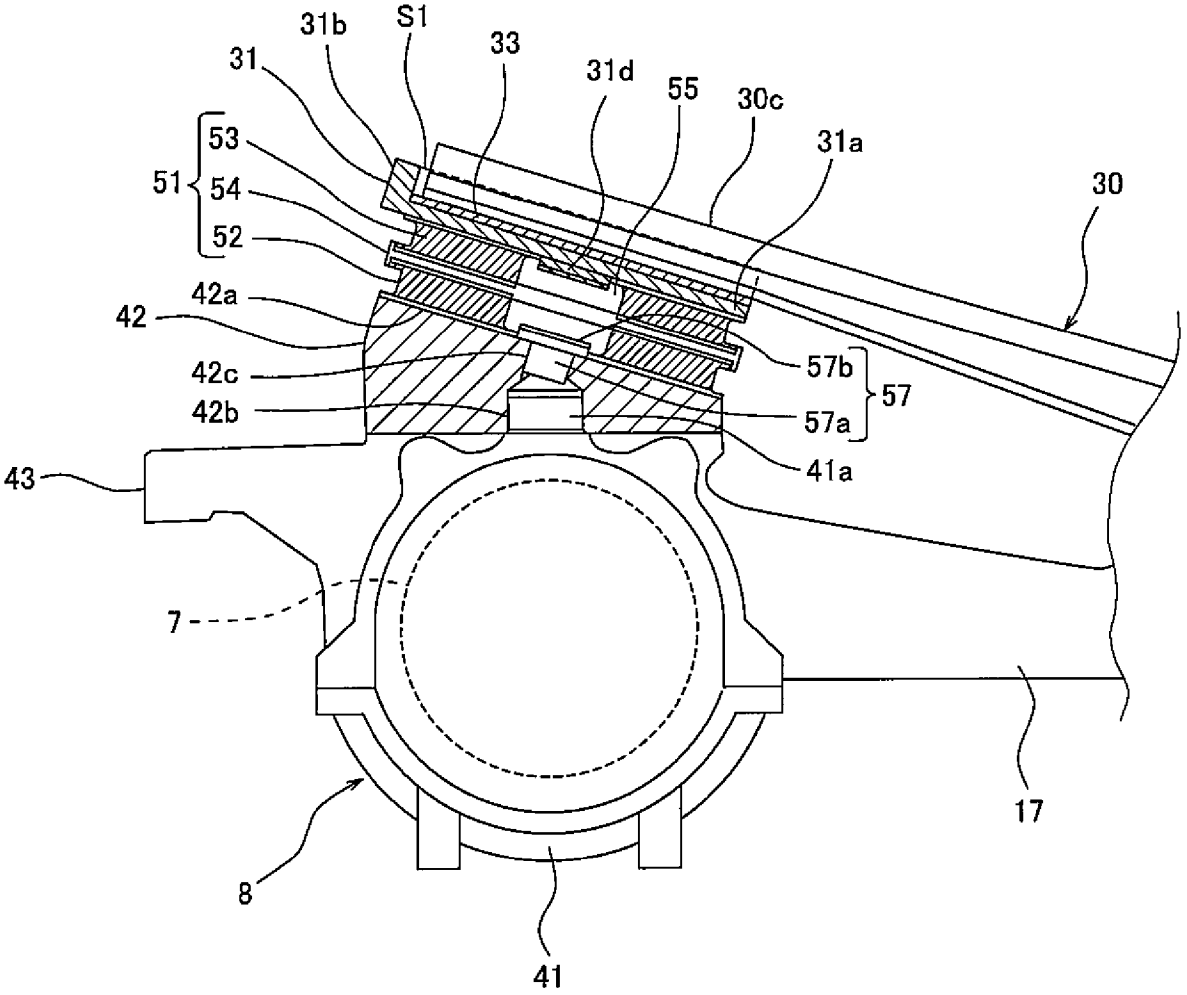
FIG. 4 is a side view of major components of the bogie shown in FIG. 3, a part of the side view being shown as a cross-sectional view.
Figure 5:
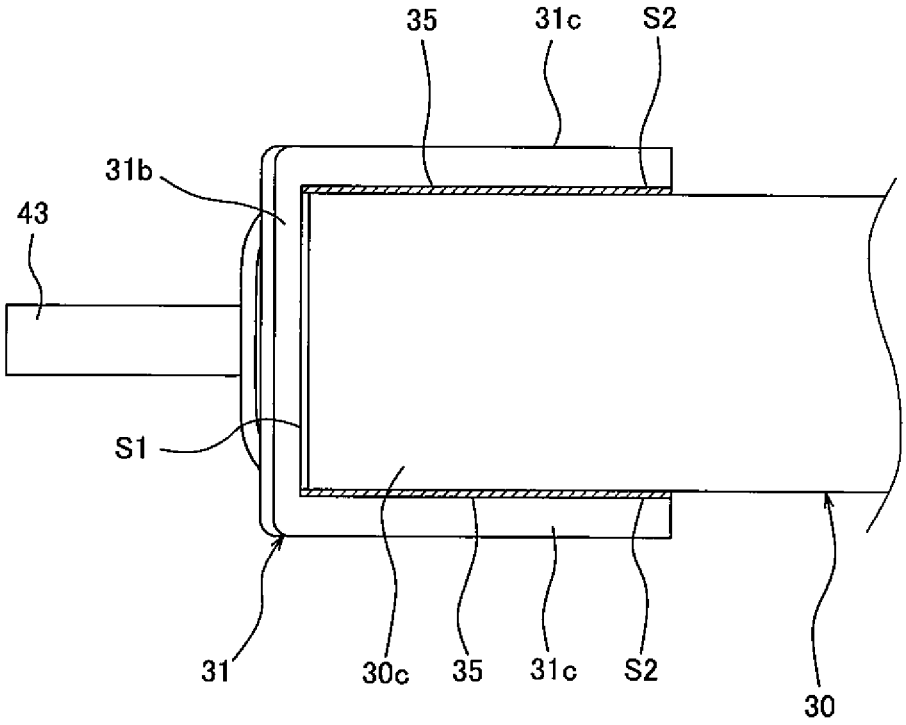
FIG. 5 is a plan view of the major components of the bogie shown in FIG. 4.

FIG. 4 is a side view of major components of the bogie 1 shown in FIG. 3, a part of the side view being shown as a cross-sectional view. FIG. 5 is a plan view of the major components of the bogie 1 shown in FIG. 4. As shown in FIGS. 4 and 5, the spring seat 42 of the axle box portion 8 is a member provided on an upper surface of the axle box main body 41 and constituted by a rigid body (such as metal or resin). The spring seat 42 includes an upper surface 42*a* as a supporting surface that supports the plate spring 30. The upper surface 42*a* of the spring seat 42 is inclined obliquely downward toward a longitudinal direction middle side of the plate spring 30 and is substantially parallel to a lower surface of the longitudinal direction end portion 30*c* of the plate spring 30. An insertion projection 41*a* projecting upward is formed on the upper surface of the axle box main body 41, and an insertion hole 42*b* is formed at a middle of a lower surface of the spring seat 42. The insertion projection 41*a* is inserted in the insertion hole 42*b*, so that the spring seat 42 does not horizontally move relative to the upper surface of the axle box main body 41.

An insertion hole 42*c* is formed at a middle of the upper surface 42*a* of the spring seat 42, and a pin member 57 is screwed into the insertion hole 42*c* to be attached to the insertion hole 42*c*. Specifically, the pin member 57 includes: a shaft portion 57*a* on which threads are formed; and a head portion 57*b* that is provided at an upper end of the shaft portion 57*a* and is larger in diameter than the shaft portion 57*a*. In a state where the shaft portion 57*a* is threadedly engaged with the insertion hole 42*c*, the head portion 57*b* projects above the upper surface 42*a* of the spring seat 42. The pin member 57 may be formed integrally with the spring seat 42.

A gap body 51 is provided on the spring seat 42. The gap body 51 includes: a pair of elastic plates 52 and 53, each of which is configured such that plates made of metal or resin are respectively adhered to upper and lower surfaces of a rubber plate; and a coupling seat 54 interposed between the elastic plates 52 and 53. An insertion hole 55 is formed at a middle of the gap body 51 so as to penetrate the gap body 51 in the upper lower direction. The head portion 57*b* of the pin member 57 provided at the spring seat 42 is inserted into the insertion hole 55 of the gap body 51 from below. With this, the gap body 51 is positioned relative to the upper surface of the spring seat 42. In the present embodiment, the elastic plates 52 and 53 and the coupling seat 54 are configured as separate members but may be formed integrally.

The receiving member 31 constituted by a rigid body (such as metal or resin) is interposed between the plate spring 30 and the gap body 51. The receiving member 31 integrally includes: a bottom wall 31*a* which is provided on the gap body 51 and at which the plate spring 30 is disposed from above; a first side wall 31*b* projecting upward from a front-rear direction outer side of the bottom wall 31*a*; and a pair of second side walls 31*c* respectively projecting upward from both railcar width direction sides of the bottom wall 31*a*. The first side wall 31*b* is arranged at a plate spring longitudinal direction outer side of the longitudinal direction end portion 30*c* of the plate spring 30 and restricts the movement of the plate spring 30 toward the longitudinal direction outer side. The second side walls 31*c* are arranged so as to be respectively opposed to both railcar width direction side surfaces of the longitudinal direction end portion 30*c* of the plate spring 30 and restrict the movement of the plate spring 30 toward both railcar width direction sides. A projection 31*d* projects downward integrally from a lower surface of the bottom wall 31*a*. The projection 31*d* is inserted into the insertion hole 55 of the gap body 51 from above, so that the receiving member 31 is positioned relative to the gap body 51. Thus, the parallel displacement of the receiving member 31 relative to the upper surface of the axle box main body 41 via the gap body 51 is restricted.

A sheet 33 (such as a rubber sheet) that is lower in hardness than the plate spring 30 and the bottom wall 31*a* is sandwiched between the bottom wall 31*a* of the receiving member 31 and the plate spring 30. A space S1 is formed between the plate spring 30 and the first side wall 31*b* of the receiving member 31, and a space S2 is formed between the plate spring 30 and each second side wall 31*c* of the receiving member 31. Here, in the present embodiment, to facilitate the adjustments of the spaces, it is preferable that: when assembling the bogie (that is, in a state where the carbody is not mounted on the bogie 1), the space S1 be about 5 to 20 mm, and the space S2 be about 2.5 mm (the sum of the spaces S2 in the width direction is about 5 mm); and when the empty carbody is mounted on the bogie 1, the axle box main bodies 41 are displaced via the axle beams 17, and the space S1 become about 0 to 2 mm. However, the values of the spaces S1 and S2 are just examples and may be such values that the functions of the plate springs 30 can be obtained even in the case of the occurrence of the displacement. The space S2 may be such a value that the plate spring 30 can be inserted when assembling the bogie. An interposed member 35 (such as rubber) that is lower in hardness than the plate spring 30 and the second side wall 31*c* is inserted in the space S2 between the second side wall 31*c* and the plate spring 30. In the present embodiment, the interposed member is not inserted in the space S1 between the first side wall 31*b* and the plate spring 30 but may be inserted in the space S1.

According to the above-explained configuration, the parallel displacement of the receiving member 31 relative to the upper surface of the axle box main body 41 is restricted, and the first side wall 31*b* and second side walls 31*c* of the receiving member 31 can prevent the plate spring 30 from being displaced parallel relative to the axle box main body 41 beyond the scope of the assumption. Further, the first side wall 31*b*, the second side walls 31*c*, and the bottom wall 31*a* integrally constitute the receiving member 31. The receiving member 31 is disposed on the gap body 51, and the projection 31*d* is just fitted in the insertion hole 55. Therefore, the displacement of the plate spring 30 can be simply, easily prevented.

Since the sheet 33 that is lower in hardness than the plate spring 30 and the receiving member 31 is sandwiched between a lower surface of the plate spring 30 and an upper surface of the bottom wall 31*a* of the receiving member 31, the plate spring 30 and the receiving member 31 can be protected from abrasion or the like. Further, since the interposed member 35 that is lower in hardness than the plate spring 30 and the receiving member 31 is sandwiched between each side end of the plate spring 30 and each second side wall 31*c* of the receiving member 31, the plate spring 30 can be positioned in the railcar width direction, and the plate spring 30 and the receiving member 31 can be more satisfactorily protected from abrasion or the like.

Since the upper surface 42*a* of the spring seat 42 is inclined obliquely downward toward the longitudinal direction middle side (in FIG. 4, a right side) of the plate spring, the upper surface of the bottom wall 31*a* of the receiving member 31 disposed on the upper surface 42*a* via the gap body 51 is inclined similarly. Therefore, the longitudinal direction end portions 30*c* of the plate spring 30 can be inclined, and the plate spring 30 having the bow shape can be formed to have a smooth shape (in the present embodiment, a substantially straight shape) in a side view from the longitudinal direction middle portion 30*a* toward the longitudinal direction end portions 30*c*. On this account, the plate spring 30 can be easily formed, and the formability of the plate spring 30 is improved.

Surfaces of the sheet 33 sandwiched between the bottom wall 31*a* of the receiving member 31 and the plate spring 30 may have adhesiveness, the surfaces respectively contacting the plate spring 30 and the bottom wall 31*a*. For example, adhesives may be provided on the surfaces of the sheet 33, or the sheet 33 itself may be made of a material having adhesiveness. One example of the sheet 33 is a sheet made of adhesive rubber. With this, even in a case where the plate spring 30 is not pressed against the receiving member 31 by metal fittings or the like, the displacement of the plate spring 30 relative to the receiving member 31 can be suppressed at the time of traveling vibrations.

Embodiment 2

Figure 6:
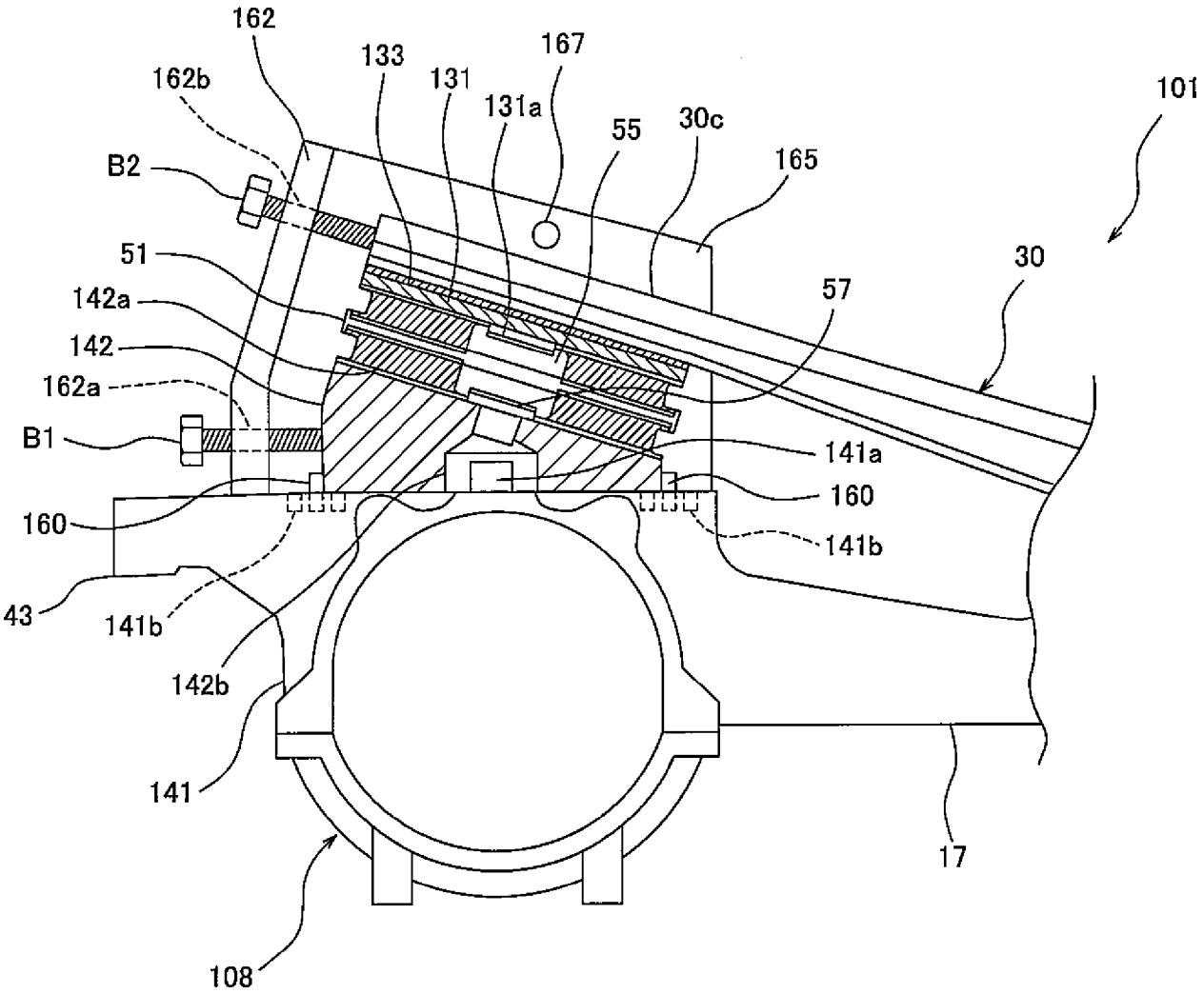
FIG. 6 is a side view of the major components of the railcar bogie according to Embodiment 2, a part of the side view being shown as a cross-sectional view.
Figure 7:
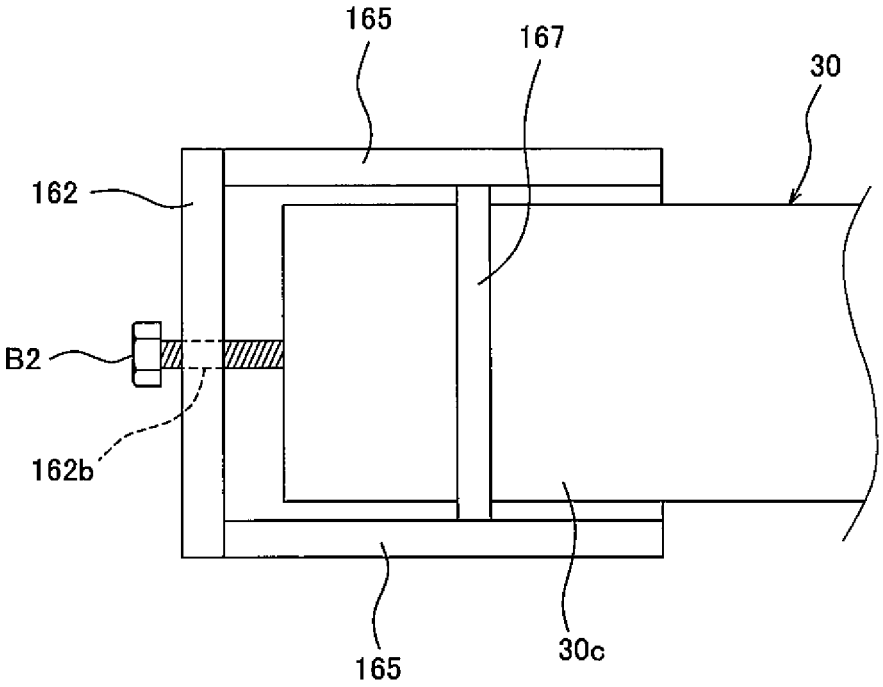
FIG. 7 is a plan view of the major components of the bogie shown in FIG. 6, when viewed from a normal direction of a plate spring.

FIG. 6 is a side view of the major components of a railcar bogie 101 according to Embodiment 2, a part of the side view being shown as a cross-sectional view. FIG. 7 is a plan view of the major components of the bogie 101 shown in FIG. 6, when viewed from a normal direction of the plate spring. The railcar bogie 101 of the present embodiment is characterized in that: the position of the plate spring 30 and the position of the spring seat 142 can be adjusted; and by the positional adjustments of the plate spring 30 and the spring seat 142, the spring constant of the plate spring 30 can be changed.

As shown in FIGS. 6 and 7, in the bogie 101 of the present embodiment, an insertion projection 141*a* of an axle box main body 141 is fitted in an insertion hole 142*b* of the spring seat 142 with a play, and the position of the spring seat 142 can be adjusted in the horizontal direction. A plurality of positioning holes 141*b* are formed on an upper surface of the axle box main body 141 so as to be lined up in the front-rear direction. Each of positioning members 160 is inserted in a selected one of the positioning holes 141*b*. Thus, the spring seat 142 is prevented from moving in the front-rear direction. The positioning members 160 in the present embodiment are, for example, columnar metal pins. A plurality of positioning members 160 are arranged in the vicinity of each of front and rear ends of the spring seat 142. The depth of the positioning hole 141*b* is about half the length of the positioning member 160. Therefore, in a state where the positioning members 160 are respectively inserted in the positioning holes 141*b*, upper half portions of the positioning members 160 project from the upper surface of the axle box main body 141.

A plate-shaped receiving seat 131 constituted by a rigid body (such as metal or resin) is disposed on the gap body 51. A projection 131*a* projecting downward from the receiving seat 131 is fitted in the insertion hole 55 of the gap body 51. A sheet 133 (such as a rubber sheet) that is lower in hardness than the receiving seat 131 and the plate spring 30 is sandwiched between the receiving seat 131 and the plate spring 30.

A first side wall 162 projecting upward is provided at the projecting portion 43 of an axle box portion 108. The first side wall 162 is opposed to a front-rear direction outer vertical end surface of the spring seat 142 and is also opposed to a front-rear direction outer inclined end surface of the longitudinal direction end portion 30*c* of the plate spring 30. A bolt hole 162*a* is formed at a position of the first side wall 162, the position being opposed to the front-rear direction outer end surface of the spring seat 142. An axis of the bolt hole 162*a* extends in a direction along a lower surface of the spring seat 142 and is substantially perpendicular to the end surface, intersecting with this axis, of the spring seat 142. A bolt hole 162*b* is formed at a position of the first side wall 162, the position being opposed to the front-rear direction outer end surface of the longitudinal direction end portion 30*c* of the plate spring 30. An axis of the bolt hole 162*b* extends in a direction along the lower surface of the longitudinal direction end portion 30*c* of the plate spring 30 and is substantially perpendicular to the front-rear direction outer end surface of the longitudinal direction end portion 30*c* of the plate spring 30. Bolts B1 and B2 for the positional adjustment can be respectively screwed into the bolt holes 162*a* and 162*b* to be attached to the bolt holes 162*a* and 162*b*.

A pair of second side walls 165 projecting upward are provided at the axle box main body 141 so as to be respectively located at both railcar width direction sides of the longitudinal direction end portion 30*c* of the plate spring 30. A stopper 167 is provided at the second side walls 165 so as to be spaced apart from and located above the longitudinal direction end portion 30*c* of the plate spring 30. The stopper 167 of the present embodiment is a pin extending between the pair of second side walls 165 in the railcar width direction. However, a flange portion projecting inward in the railcar width direction from each second side wall 165 may be provided as the stopper.

When adjusting the position of the spring seat 142 in the front-rear direction, the positioning members 160 are detached, and the bolt B1 is screwed into the bolt hole 162*a* to push the spring seat 142 by a tip end of the bolt B1. With this, the spring seat 142 can be caused to move inward in the front-rear direction. When the spring seat 142 has reached a desired position, the positioning members 160 are respectively inserted into the positioning holes 141*b* respectively located closest to the side surfaces of the spring seat 142. Thus, the spring seat 142 is held at an appropriate position. When adjusting the position of the plate spring 30 in the front-rear direction, the bolt B2 is screwed into the bolt hole 162*b* to push the front-rear direction outer end surface of the plate spring 30 by a tip end of the bolt B2. With this, the plate spring 30 can be caused to move in the front-rear direction. After the positional adjustments of the spring seat 142 and the plate spring 30 are completed, the bolts B1 and B2 may be detached from the bolt holes 162*a* and 162*b*.

According to the above-explained configuration, since the first side wall 162 and the second side walls 165 are respectively arranged at a front-rear direction outer side and both railcar width direction sides of the longitudinal direction end portion 30*c* of the plate spring 30, the plate spring 30 can be prevented from being excessively displaced. Since the bolt B1 inserted in the bolt hole 162*a* pushes the spring seat 142 having the inclined upper surface to adjust the position of the spring seat 142, the spring constant of the plate spring 30 can be changed. In addition, the adjustment of the wheel loads of the bogie 101 can be easily performed. Further, since the bolt B2 inserted in the bolt hole 162*b* pushes the front-rear direction end surface of the plate spring 30, the plate spring 30 can be easily adjusted to be located at the desired position. Since the stopper 167 is provided above the longitudinal direction end portion 30*c* of the plate spring 30, it is possible to prevent the plate spring 30 from falling down from the axle box portion 108 when the bogie 101 is lifted up at the time of assembly.

Surfaces of the sheet 133 sandwiched between the receiving seat 131 and the plate spring 30 may have adhesiveness, the surfaces respectively contacting the plate spring 30 and the receiving seat 131. For example, adhesives may be provided on the surfaces of the sheet 133, or the sheet 133 itself may be made of a material having adhesiveness. Since the other components are the same as those of Embodiment 1 described above, the same reference signs are used, and explanations of those components are omitted.

Embodiment 3

Figure 8:
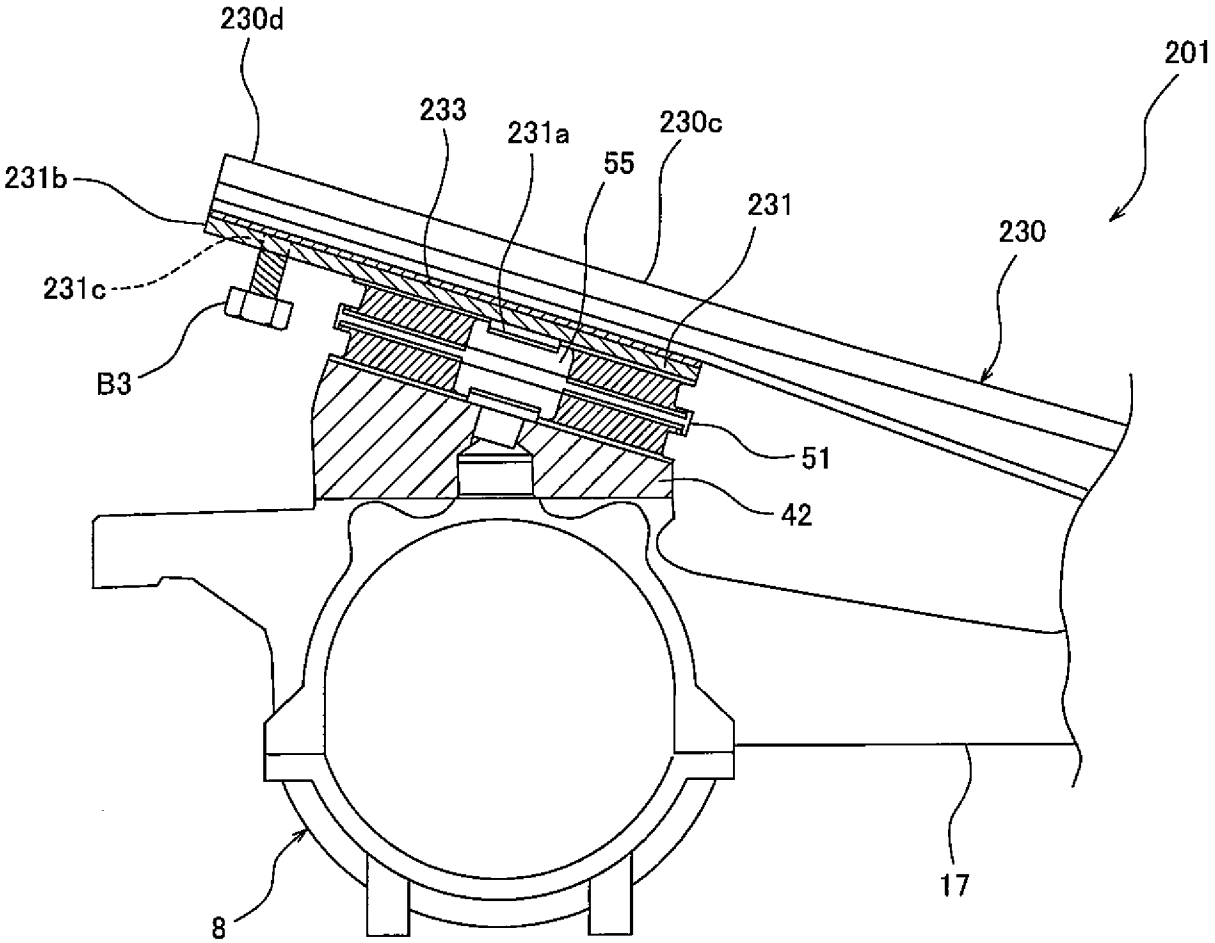
FIG. 8 is a side view of the major components of the railcar bogie according to Embodiment 3, a part of the side view being shown as a cross-sectional view.

FIG. 8 is a side view of the major components of a railcar bogie 201 according to Embodiment 3. As shown in FIG. 8, in the bogie 201 of the present embodiment, a first overhang portion 230*d* supported by a receiving seat 231 and projecting from an end portion of the supporting surface toward the outer side in the front-rear direction is provided in the vicinity of each of both longitudinal direction ends of a plate spring 230. The plate-shaped receiving seat 231 made of a rigid body (such as metal or resin) is disposed on the gap body 51, and the receiving seat 231 includes a second overhang portion 231*b* that is opposed to a lower surface of the first overhang portion 230*d* so as to be separable from the lower surface. A projection 231*a* projecting downward from the receiving seat 231 is fitted in the insertion hole 55 of the gap body 51. A sheet 233 (such as a rubber sheet) that is lower in hardness than the receiving seat 231 and the plate spring 230 is sandwiched between the receiving seat 231 and the plate spring 230.

A bolt hole 231*c* is formed at a position of the second overhang portion 231*b*, the position being opposed to the first overhang portion 230*d*. A hole is not formed at a portion of the first overhang portion 230*d*, the portion being opposed to the bolt hole 231*c*. The bolt hole 231*c* may be formed at the first overhang portion 230*d* instead of the second overhang portion 231*b*. A hole is not formed at the sheet 233, but a hole may be formed at the sheet 233 so as to correspond to the bolt hole 231*c*.

When inserting a liner (not shown) having a desired thickness into a gap between the receiving seat 231 and the sheet 233 in order to adjust the wheel loads of the wheels 6 of the bogie 201, a bolt B3 is inserted into and screwed into the bolt hole 231*c* of the second overhang portion 231*b*. With this, a tip end of the bolt B3 pushes up a lower surface of the first overhang portion 230*d* via the sheet 233, so that the first overhang portion 230*d* is separated upward from the second overhang portion 231*b*. Then, the liner is inserted in this gap formed as above. Thus, the adjustment of the wheel loads of the bogie 201 can be easily performed. When adjusting the wheel loads, instead of inserting the liner, the sheet 233 may be replaced with a sheet that is different in thickness from the sheet 233. The first overhang portion 230*d* and the second overhang portion 231*b* may directly contact each other without the sheet 233. The second overhang portion 231*b* may be formed integrally with the axle box portion 8.

Surfaces of the sheet 233 sandwiched between the receiving seat 231 and the plate spring 230 may have adhesiveness, the surfaces respectively contacting the plate spring 230 and the receiving seat 231. For example, adhesives may be provided on the surfaces of the sheet 233, and the sheet 233 itself may be made of a material having adhesiveness.

The present invention is not limited to the above embodiments, and modifications, additions, and eliminations may be made within the scope of the present invention. The above embodiments may be combined arbitrarily. A part of the configuration or method in one embodiment may be applied to another embodiment. For example, the height of the first side wall 31*b* of the receiving member 31 may be increased, and a bolt hole for the positional adjustment of the plate spring may be formed at the first side wall. The spring seat 42 may be formed integrally with a casing of the axle box main body 41.

In the above embodiments, the upper surface of the spring seat 42 is inclined obliquely downward toward the longitudinal direction middle side of the plate spring 30. However, the upper surface of the spring seat 42 may be a horizontal surface. In this case, the longitudinal direction end portion of the plate spring 30 is formed parallel to the upper surface of the spring seat 42.

INDUSTRIAL APPLICABILITY

As above, the railcar bogie according to the present invention has the above-described excellent effects. Thus, it is useful to widely apply the present invention to the railcar bogies that can utilize the significance of the above effects.

REFERENCE SIGNS LIST

1, 101, 201 railcar bogie
4 cross beam
5 axle
7 bearing
8, 108 axle box portion
11 carbody
30, 230 plate spring
30*c*, 230*c* longitudinal direction end portion
31*a* bottom wall
31*b*, 162 first side wall
31*c*, 165 second side wall
33, 133, 233 sheet
41 axle box main body
42, 142 spring seat
162*a*, 162*b*, 231*c* bolt hole
230*d* first overhang portion
231*b* second overhang portion

The invention claimed is:

1. A railcar bogie comprising:

a cross beam configured to support a carbody of a railcar;

a pair of front and rear axles between which the cross beam is located and which are respectively arranged in front of and behind the cross beam in a railcar longitudinal direction so as to extend in a railcar width direction;

bearings respectively provided at both railcar width direction sides of the axles and configured to rotatably support the axles;

axle box main bodies configured to respectively accommodate the bearings;

plate springs extending in the railcar longitudinal direction to respectively support both railcar width direction end portions of the cross beam, vicinities of both longitudinal direction ends of the plate springs being respectively supported by the axle box main bodies, each of the plate springs being provided with first overhang portions each projecting toward a longitudinal direction outer side from an end portion of a supporting surface of the axle box main body; and second overhang portions respectively formed integrally with the axle box main bodies or respectively supported by the axle box main bodies, and respectively opposed to lower surfaces of the first overhang portions so as to be separable from the lower surfaces, wherein a bolt hole is formed at a position of one of the first overhang portion and the second overhang portion, the position being opposed to the other of the first overhang portion and the second overhang portion, a gap between the first overhang portion and the second overhang portion being formed by a bolt inserted into the bolt hole.

2. The railcar bogie according to claim 1, wherein a liner is inserted in the gap.

3. The railcar bogie according to claim 1, wherein:

receiving seats respectively supported by the axle box main bodies respectively support the longitudinal direction end portions of the plate springs; and the receiving seats respectively include the second overhang portions.

4. The railcar bogie according to claim 1, wherein a sheet that is lower in hardness than the first overhang portion and the second overhang portion is sandwiched between the first overhang portion and the second overhang portion.

* * * * *